US008580081B2

(12) United States Patent
Dumas et al.

(10) Patent No.: US 8,580,081 B2
(45) Date of Patent: Nov. 12, 2013

(54) PAPER FOR SMOKING ARTICLE HAVING LOW IGNITION PROPENSITY PROPERTIES

(75) Inventors: Jocelyne Dumas, Allinges (FR); Joel Malachie, Evian Les Bains (FR); Arnaud Ruffin, Amphion-Les-Bains (FR); Julie Jeanrot, Publier (FR)

(73) Assignee: Papeteries du Leman, Amphion-les-Baines (FR)

( * ) Notice: Subject to any disclaimer, the term of this patent is extended or adjusted under 35 U.S.C. 154(b) by 0 days.

(21) Appl. No.: 13/111,884

(22) Filed: May 19, 2011

(65) Prior Publication Data

US 2011/0290436 A1 Dec. 1, 2011

(30) Foreign Application Priority Data

May 20, 2010 (FR) ..... 10 53934

(51) Int. Cl.

| | |
|---|---|
| ***D21H 27/00*** | (2006.01) |
| ***D21H 19/00*** | (2006.01) |
| ***D21H 19/72*** | (2006.01) |
| ***B82Y 30/00*** | (2011.01) |

(52) U.S. Cl.

USPC ..... 162/139; 162/135; 162/136; 131/334; 131/360; 428/195.1; 977/773; 977/734; 977/762

(58) Field of Classification Search

USPC ..... 162/135–137, 139, 175, 177, 181.1, 162/181.4; 131/334, 360, 362–365; 428/195.1; 977/734, 762, 773, 775

See application file for complete search history.

(56) References Cited

U.S. PATENT DOCUMENTS

| | | | | |
|---|---|---|---|---|
| 7,168,431 | B2 * | 1/2007 | Li et al. | 131/334 |
| 7,243,658 | B2 * | 7/2007 | Deevi et al. | 131/334 |
| 7,566,493 | B2 * | 7/2009 | Richardson et al. | 428/323 |
| 7,934,510 | B2 * | 5/2011 | Gedevanishvili et al. | 131/334 |
| 2003/0145762 | A1 * | 8/2003 | Richardson et al. | 106/163.01 |
| 2004/0134631 | A1 | 7/2004 | Crooks et al. | |
| 2004/0226671 | A1 * | 11/2004 | Nguyen et al. | 162/25 |
| 2004/0237980 | A1 * | 12/2004 | Holmes | 131/284 |
| 2005/0051185 | A1 * | 3/2005 | Rasouli et al. | 131/365 |
| 2005/0139223 | A1 * | 6/2005 | Squires et al. | 131/331 |
| 2005/0211259 | A1 | 9/2005 | Gedevanishvili | |
| 2006/0144535 | A1 * | 7/2006 | Nguyen et al. | 162/103 |
| 2006/0225753 | A1 * | 10/2006 | Kaczmarek et al. | 131/334 |
| 2008/0149120 | A1 * | 6/2008 | Squires et al. | 131/345 |
| 2008/0216852 | A1 * | 9/2008 | Rasouli et al. | 131/281 |
| 2009/0126891 | A1 * | 5/2009 | Koivunen et al. | 162/176 |
| 2010/0233468 | A1 * | 9/2010 | Ioelovich et al. | 428/326 |
| 2011/0009259 | A1 * | 1/2011 | Innerlohinger et al. | 502/402 |
| 2011/0041861 | A1 * | 2/2011 | Sebastian et al. | 131/365 |
| 2011/0189471 | A1 * | 8/2011 | Ziegler et al. | 428/323 |
| 2011/0277947 | A1 * | 11/2011 | Hua et al. | 162/28 |
| 2011/0290436 | A1 * | 12/2011 | Dumas et al. | 162/136 |
| 2012/0024304 | A1 * | 2/2012 | Sebastian | 131/332 |
| 2012/0043039 | A1 * | 2/2012 | Paltakari et al. | 162/157.6 |

(Continued)

FOREIGN PATENT DOCUMENTS

WO WO 2008/081342 A2 7/2008

*Primary Examiner* — Jose A Fortuna

(74) *Attorney, Agent, or Firm* — Blakely Sokoloff Taylor & Zafman

(57) ABSTRACT

The invention concerns a paper for smoking article, in particular for a cigarette, comprising areas treated with a coating formulation adapted to reduce the ignition propensity of said treated areas which comprises nanoparticles of cellulose having a median dimension (d50) equal to or less than five micrometers.

18 Claims, 1 Drawing Sheet

(56) References Cited

U.S. PATENT DOCUMENTS

2012/0132380 A1* 5/2012 Hentze et al. ..... 162/141
2012/0132381 A1* 5/2012 Hentze et al. ..... 162/149
2012/0227754 A1* 9/2012 Norman et al. ..... 131/365
2012/0227920 A1* 9/2012 Juppo et al. ..... 162/164.6

* cited by examiner

PAPER FOR SMOKING ARTICLE HAVING LOW IGNITION PROPENSITY PROPERTIES

BACKGROUND OF THE INVENTION

1. Field of the Invention

The invention concerns a paper for smoking articles having low ignition propensity.

2. Description of Related Art

Conventionally, cigarette papers intended for the production of industrial cigarettes are made from cellulose fibres (fibres from wood and/or plant textile fibres with the addition of calcium carbonate to the fibrous suspension as conventional pigment).

Combustion delaying or accelerating salts are conventionally applied over the entire surface during manufacture, to gain control over some burn parameters of the formed cigarette. These are generally sodium salts, potassium salts, magnesium salts, etc. They also impart improved combustibility to cigarettes.

Current standards require cigarette manufacturers to observe levels of tar, nicotine, carbon monoxide (CO) per cigarette lying below given thresholds. For example, European regulations require thresholds of 10 mg per cigarette for tar, 1 mg per cigarette for nicotine and 10 mg per cigarette for carbon monoxide.

It has been ascertained that the reduction in condensates of the particle phase (tar and nicotine) and of carbon monoxide in cigarette smoke is proportional to the increase in natural porosity of the paper. For example, the use of paper having high initial permeability of between 10 and 200 Coresta (CU, or mL/min/cm$^2$) allows a reduction to be obtained of 28% for tar, about 20% for nicotine and 45% carbon monoxide.

The most part of this gain is acquired as soon as the level of 70 Coresta is reached, with an additional reduction over the range 100-200 CU.

Paper manufacturers, moreover, have been led to proposing papers having low ignition propensity to limit the risks of self-combustion of cigarettes. The objective of these papers is to achieve extinguishing of the cigarette if combustion is not maintained through a supply of oxygen i.e. if the smoker does not "draw" on the cigarette. These papers are currently known as "LIP" papers (for Low Ignition Propensity) and comprise LIP-bands treated with a film-forming formulation adapted to block the pores of the paper and thereby reduce the permeability of the paper in these areas. The alternation of areas treated with film-forming formulation and of non-treated areas allows the ignition propensity of the paper to be reduced by partially depriving of oxygen the burning cone of the cigarette when it reaches the areas of low permeability (closed).

However the LIP areas have a harmful effect on tar, nicotine and carbon monoxide levels per cigarette, since they reduce the natural porosity of the paper. It has therefore been proposed to increase initial porosity significantly by applying combustion salts to the paper before treating some areas with the film-forming formulation.

It has also been proposed to coat all or part of the paper with burn delaying salts which cause endothermic reactions during combustion of the paper. Their combustion, on the other hand, generates carbon dioxide ($CO_2$), dinitrogen ($N_2$) and water.

The treated areas are generally transverse rings formed on all or part of the cigarette. Nevertheless, the discrete treatment of the sheet of paper in successive bands, separated by areas not treated with the film-forming formulation, sets up stresses in the sheet of paper which often generate problems when processing the paper, in particular when the treated paper is spooled. The paper effectively has a tendency to bulge outwardly at the localized areas.

Here the propensity of cigarettes to cause fire was evaluated following the ASTM E 2187-04 test method. This test method measures the probability that a cigarette placed on a substrate produces sufficient heat to maintain burning of the tobacco column irrespective of the composition of the tobacco used. Each determination consists of placing a lit cigarette on a horizontal surface formed of a given number of layers of filter paper (ten thicknesses).

It is then determined whether the cigarette continues to burn its full length as far as the end-tip paper.

Forty determinations (forming one test) are conducted to obtain the relative probability that the cigarette will continue to burn despite absorption of heat by the substrate.

In addition to the evaluation test for ignition propensity as per the ASTM E 2187-04 test method, it is also possible to evaluate the percentage number of cigarettes which self-extinguish in free air (EASE test, for Free Air Self Extinguishment). Free combustion is characterized here by the capacity of the lighted cone of the cigarette to travel along the full length of the cigarette despite the presence of treated areas, without any drawing on the cigarette.

Finally, a diffusivity test was also carried out, allowing more rapid and easier prediction of the LIP nature of a paper. This test was conducted on LIP-treated areas by measuring the capacity of the paper to diffuse carbon dioxide. Prediction gives good results when the diffusivity of carbon dioxide is lower than 0.3 cm/s, and more preferably lower than 0.2 cm/s.

The apparatus used to measure diffusivity was SODIM D-95 diffusion measurement equipment.

The formulations containing film-forming compounds are generally applied by printing, typically by heliograph, serigraphy or flexography, and they must therefore have particular dry extract and viscosity characteristics.

It has been observed however that the use of LIP papers affects the functional aspects of a cigarette, in particular the taste, ash integrity, effective carbon monoxide level, etc. Also, it has been ascertained that when a smoker re-lights a cigarette at one of the LIP-treated areas, the taste and carbon monoxide level are modified.

BRIEF SUMMARY OF THE INVENTION

It is one objective of the application to propose a novel LIP paper capable of preserving the functional aspects of a cigarette without generating any secondary effect having an adverse influence on the levels of carbon monoxide, nicotine and tar, even after a cigarette has been re-lit. For example, it is sought to obtain a paper having a FASE rate of 50% or less for smoker comfort, and a cigarette burn percentage as per the ASTM test that is equal to or less than 25%.

Secondarily, a further objective of the application is to propose a LIP paper that is easier to process.

For this purpose, the invention proposes a paper for smoking article, notably for a cigarette, comprising areas treated with a coating formulation adapted to reduce the ignition propensity of said treated areas, wherein the formulation comprises nanoparticles of cellulose having a median dimension (d50) of five micrometers or less.

Cellulose is formed of a linear homopolysaccharide composed of βD-glucopyranoses linked together in β1-4 conformation. The chemical structure of cellulose is therefore composed of cellobiose moieties that repeat, each monomer carrying three hydroxyl groups. The capability of forming bonds via hydrogen bridges therefore plays a direct role in the physical properties of cellulose.

In general, the length of the polymer chain varies according to the cellulose source and the part of the plant concerned. For example, native wood cellulose has a degree of polymerization (DP) of approximately 10000 glucopyranose moieties, whilst native cotton cellulose has a DP of around 15000.

Microfibril of cellulose is the structural basis of cellulose formed during biosynthesis. It comprises hemicellulose, para-crystalline cellulose and cellulose.

Nano-fibre of cellulose is produced from native cellulose which has been subjected to specific conventional treatment to rid it of lignin. It is then bleached.

A distinction can globally be made between two families of cellulose particles on nano-scale, the first comprising cellulose nano-crystals (NC—also known as <<whiskers>>), the second being formed of micro-fibrillated cellulose (NFC).

The terms microfibrillated cellulose, micro-crystallite and micro-crystal are also used despite their nano-scale sizes (cellulose micro-fibrils and cellulose nano-fibrils).

Cellulose nano-crystals can be prepared from various cellulose sources (flax, hemp, annual plants, rice straw, cotton, hardwood, softwood, sisal, etc.) by acid hydrolysis after conventional boiling and bleaching treatment.

Analysis under a scanning microscope allows characterization of the form of the nano-fibres, the size and shapes of their nano-crystals depending upon the type of cellulose source and on conditions of hydrolysis, temperature, time and the purity of the raw material (percentage of cellulose and hemicellulose in the lignin-cellulose composition of the fibre).

The typical dimensions of cellulose nano-crystals vary from 5 to 10 nm in diameter and from 100 to 500 nm in length. Their shape is similar to nanotubes (nano-rods).

Nano-fibrillated cellulose is extracted using a mechanical disintegration process of wood fibre after conventional boiling and bleaching chemical treatments.

Nano-fibrillated cellulose can be seen as a moderately degraded cellulose compound with high specific surface area. It is composed of individualized nano-fibres having lateral dimensions of the order of 10 to 100 nm and a length possibly reaching one micron, and consisting of alternating crystalline and amorphous regions.

Said cellulose nanoparticles (NC and NFC) can be used as pigment and can increase the barrier properties of bio-composites.

Some preferred, but non-limiting, aspects are the following:

- the nanoparticles comprise nanofibres, nanotubes, nanofilaments and/or nanorods;
- the nanoparticles at least have a dimension of 100 nm or less when taken individually;
- the nanoparticles are nano-dispersed cellulose (NDC);
- the areas are also treated with a formulation comprising a film-forming compound, such as starch, carboxymethylcellulose and/or methylcellulose;
- the formulation further comprises a film-forming compound such as starch, carboxymethylcellulose and/or methylcellulose;
- the treated areas are separated from each other by areas not treated with the coating formulation, and in that the non-treated areas with the coating formulation are treated with combustion accelerating salts;
- the combustion accelerating salts are solely applied to the non-treated areas;
- the treated areas are transverse bands having a width of between four and eight millimeters, and spaced apart two by two by a distance of between fifteen and twenty millimeters; and
- the formulation further comprises pigments, notably aluminium hydroxide.

According to a second aspect, the invention concerns a smoking article comprising a paper conforming to the invention.

According to a final aspect, the invention concerns a method for manufacturing a paper conforming to the invention, which comprises the following steps:

- providing a paper for smoking article, and
- applying, to discrete areas of the paper, at least one layer of a coating formulation adapted to reduce the ignition propensity of said discrete areas, said formulation comprising nanoparticles of cellulose.

Some preferred, but non-limiting, aspects of the method of manufacture according to the invention are the following:

- the method further comprises a step to apply at least one layer of combustion accelerator salts to areas not treated with the coating formulation;
- the method further comprises a step to apply a starch layer to the treated areas;
- the formulation comprising nanoparticles of cellulose also comprises starch, and the method is characterized in that it further comprises a step during which the formulation containing the cellulose nanoparticles is mixed with the starch prior to application of said formulation to the paper;
- the nanoparticles are applied in hydrated form in an aqueous solution containing between 5 and 15% dry extract of nanoparticles; and
- the layers are applied by heliography, serigraphy or flexography.

BRIEF DESCRIPTION OF THE DRAWINGS

Other characteristics, objectives and advantages of the present invention will become better apparent on reading the detailed description below in connection with the appended drawings given as non-limiting examples and in which.

DETAILED DESCRIPTION OF THE INVENTION

Figure 1:
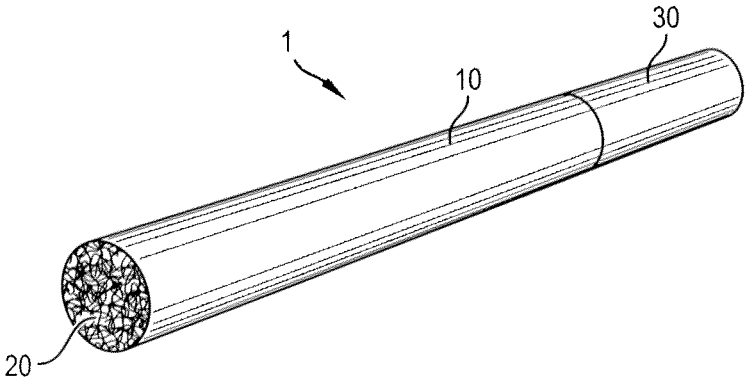
FIG. 1 is an example of a smoking article.

FIG. 1 illustrates an example of a smoking article to which the invention can be applied. It is a cigarette comprising a roll of tobacco 20 enclosed in a paper 10 and with a filter 30.

Figure 2:
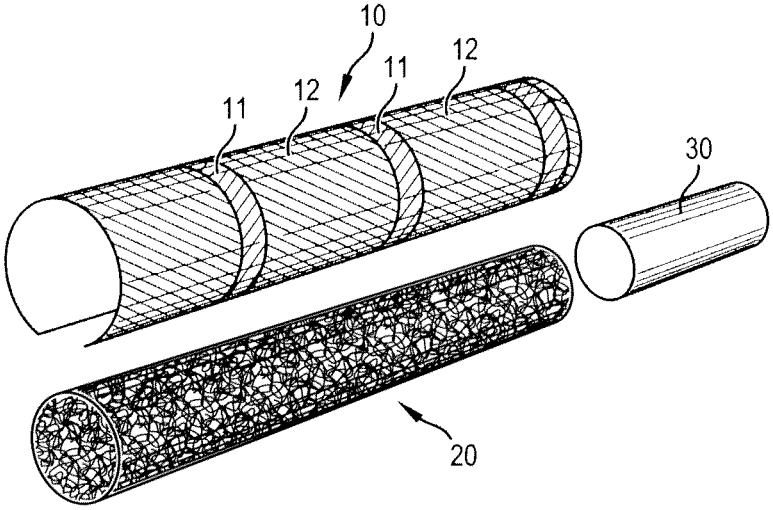
FIG. 2 is an exploded view of a smoking article of the type shown in FIG. 1.
Figure 3:
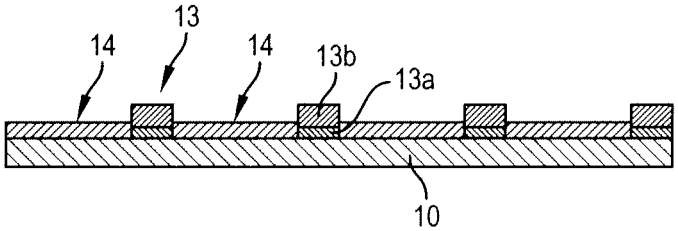
FIG. 3 is a cross-sectional view of one form of embodiment of paper conforming to the invention (not drawn to scale).

FIGS. 2 and 3 illustrate papers for a smoking article 1 conforming to the present invention.

The paper 10 used here has an initial, natural permeability (i.e. before any treatment) of between 10 Coresta and about 200 Coresta, preferably of the order of 10 to 80 Coresta, further preferably from 60 to 80 Coresta. It may be any commercially available paper for smoking articles.

To make this paper 10 a LIP paper, it is treated to form a series of areas 11 having properties of low ignition propensity (LIP areas).

To do so, during a first step a coating formulation 13 is applied to the paper, the formulation being adapted to reduce porosity by blocking at least partly all or part of the pores. Here the formulation 13 is preferably applied in discrete fashion. For example treated bands 11 are formed extending transversally over the paper, having a width of between about five millimeters and eight millimeters and separated from each other by a distance of between about fifteen and twenty millimeters.

According to the invention, the coating formulation 13 notably comprises nanoparticles of cellulose 13*a*.

By nanoparticles of cellulose 13 herein is meant cellulose whose particles have a median dimension d50 of five micrometers or less and/or whose fibres taken individually at least have a dimension of less than 100 nm.

This median dimension d50 is a mean dimension of the nanoparticles which have a tendency to form aggregates (or clusters) and represents the accumulated particle size distribution in equivalent diameter of the particles taken at point 50%. For example a nanofibre of primary cellulose suitable for use in the invention can have a thickness of the order of twenty nanometers for a length of about one hundred nanometers, whilst 50% of the clusters formed by the nanofibres will have an equivalent diameter smaller than the d50 of the nanofibre, typically about three to four micrometers.

The use of said particles is of twofold advantage; firstly the basic material of the formulation i.e. the cellulose has high compatibility with the material used for manufacture of the paper 20, which is also made from cellulose. Secondly, the coating of the paper with cellulose nanoparticles allows the natural porosity of the paper to be reduced. The nanoparticles partly fill the natural pores of the paper and set up a sub-network of artificial pores within the initial natural pores (increase in the number of pores of the paper and reduction in their respective size).

The treated areas 11 of the paper therefore have lower permeability than the areas 12 non-treated with the formulation, and therefore allow tar, nicotine and carbon monoxide levels to be obtained that are substantially similar to the levels of the non-treated paper having the same natural permeability as the treated areas 11, whilst imparting LIP characteristics to the paper 10. It is therefore possible naturally to maintain the low toxicity aspect of the paper 10 for smoking article 1 whilst reducing the permeability thereof in discrete areas 11.

It was additionally observed that papers 10 comprising the formulation 13 containing cellulose nanoparticles in discrete areas 11 have similar, even identical diffusivity to papers naturally having the same initial porosity.

Therefore the use of cellulose nanoparticles allows an artificial reduction in the permeability of the paper in delimited areas, so as to obtain a paper having low ignition propensity whilst preserving its diffusivity, which confirms that the paper thus obtained can be used to produce smoking articles whose toxicity (nicotine, tar and carbon monoxide levels) is substantially similar to that of a paper that is not LIP-treated. The micro-capillarity or the microtortuosity obtained by means of the cellulose nanoparticles effectively allow a better exchange of gases as compared with conventional film-forming formulations which merely close the pores by blockage (to reduce the natural porosity of the paper) and form an obstacle to the diffusion of gases through the paper.

The coating formulation 13 also comprises elements such as binders, additives, pigments (e.g. aluminium hydroxide) etc., in proportions conforming to conventional LIP formulations.

The cellulose is preferably of plant origin. For example, the cellulose used is in the form of cellulose nanocrystals (NC) or micro-fibrillated cellulose (NFC).

Also, the nanoparticles can be nanofibres, nanotubes, nanofilaments or even nanorods.

Preferably, the nanoparticles are nanofibres, which may or may not be fibrillated.

In the following examples, a description is given for example of the use of nano-dispersed cellulose particles (NDC) either alone or in a mixture with other compounds of equivalent size or on micrometric scale. The nano-dispersed cellulose is a water-insoluble nanofibre having high water-retaining capacity even at high temperatures and under substantial shear forces. Typically, an aqueous solution containing 10% dry extract of nano-dispersed cellulose is in the form of a gel, whilst the solution with 40% dry extract of nano-dispersed cellulose behaves like a dry powder whilst being fully plant-derived.

Here, the nanoparticles are applied in hydrated form in an aqueous solution containing between 5 and 15% dry extract of nanoparticles, preferably about 10%. The nano-dispersed cellulose may be Arbocel MF 40-100 Ultrafine cellulose marketed by JRS PHARMA.

According to one preferred embodiment, the median dimension d50 of the nano-dispersed cellulose nanofibres is less than one micrometer.

Also, the nano-dispersed cellulose is preferably applied in gel form, so that it has better water-retaining properties. In this manner, the nano-dispersed cellulose only enters into the pores on the surface of the paper (over a thickness of about 4 to 6 micrometers for a total paper thickness of about thirty micrometers for example) by re-creating hydrogen bonds so as to partly block the pores on the surface and to set up a denser pore structure on nanometric scale.

The layer of nano-dispersed cellulose 13 is therefore applied to discrete areas on the paper 10, preferably after removal from the paper machine. In particular, it can be applied on a printing machine, typically by flexography, heliography or serigraphy.

For this purpose, it is possible for example to apply a mask adapted to the dimensions of the non-treated areas 12 of the paper, so as to print the LIP-bands with accuracy. Said technique for locally printing discrete areas onto paper is known to the person skilled in the art of printing, and will not be further detailed in this description.

The use of printing machines is effectively more flexible than paper machines, and allows easier integration of the different mechanical constraints which may vary from one smoking article to another (coating formulation used varying in relation to the quality of tobacco used for the smoking article, pressure applied to the paper, viscosity of the formulation, etc.).

Additionally, the formulation 13 can be applied in one or more passes, it may contain different fillers (dry extract percentage, pigments, etc) and/or it may be composed of different materials on each pass.

For example, for a further increase in the LIP effect of the treated areas 11, it is possible to apply two different coating formulations 13*a* 13*b* (as illustrated FIG. 3) in at least two consecutive passes, the first pass comprising a coating formulation 13*a* containing nano-dispersed cellulose, the second pass comprising a coating formulation 13*b* containing a conventional film-forming compound such as starch, polyvinyl alcohol, methylcellulose, hydroxymethylcellulose, etc. The Applicant has noticed that with nano-dispersed cellulose 13*a*, the binders and additives (notably the film-forming compound 13*b*) present in the formulation 13 are better maintained on the surface, thereby improving their respective performance.

As a variant, the coating formulation 13 comprises both nano-dispersed cellulose and the film-forming compound e.g. starch, so that the nano-dispersed cellulose and starch are applied simultaneously onto the paper.

Whether the nano-dispersed cellulose and starch are applied separately or simultaneously to the paper, it is observed that the LIP effect obtained (low ignition propensity) is the result of synergy between the nano-dispersed cellulose and the starch. Not only the obtained paper 10 has low ignition propensity, but in also this propensity is lower than what would have been obtained by applying solely nano-dispersed cellulose or solely starch in similar proportions.

In addition, the paper 10 in the treated areas 11 has high diffusivity, which means that the toxicity (nicotine, tar and carbon monoxide levels per cigarette) of the paper 10 obtained remains in conformity with the standards generally laid down (10 mg per cigarette for tar, 1 mg per cigarette for nicotine and 10 mg per cigarette for carbon monoxide).

Finally, there is also an improvement on the FASE percentage compared with cases when starch is used alone.

The table below reproduces the examples of formulations containing both nano-dispersed cellulose and starch applied to discrete areas of a paper for smoking articles.

In all cases, whether the coatings are applied at one or more coating stations, for this test plan only a fraction of the surface of the paper was coated with transverse bands 11 having a 7 mm width spaced apart every 18 to 20 mm.

Industrially, this type of test plan is accessible to printing machines using heliography, flexography or serigraphy, and more particularly a flexography machine comprising 1 to 8 printing stations.

The ASTM and FASE tests were conducted on cigarettes 1 manufactured industrially from papers obtained in accordance with the indicated treatment. The papers 10 used were treated uniformly with burn rate accelerator salts (potassium citrate).

For Test No. 1, the coating formulation 13 comprised a volume of 69 $cm^3/m^2$ nano-dispersed cellulose having a solid content of 10% (corresponding to a theoretical deposit of 6.9 $g/m^2$).

For Test No. 2, the coating formulation 13 comprised a volume of 55 $cm^3/m^2$ starch (Perfectafilm 150—modified corn starch) having a solid content of 10% (corresponding to a theoretical deposit of 5.1 $g/m^2$).

For Test No. 3, the coating formulation 13 comprised an equal mixture (50/50) of starch and nano-dispersed cellulose in a solution having a solid content of 10%, in a volume of 55 $cm^3/m^2$ (corresponding to a theoretical deposit of 5.5 $g/m^2$).

For Tests No. 4, 5 and 6, two different formulations 13*a*, 13*b* were successively applied to the paper. The first formulation 13*a* contained nano-dispersed cellulose, whilst the second formulation 13*b* contained starch.

The volumes of the transfer rolls were chosen so that it was theoretically possible to transfer 2.1 $g/m^2$ dry weight of nano-dispersed cellulose, a quantity which was constant for the three tests, and different theoretical transfers for starch namely 1.0 $g/m^2$ starch for T-4, 2.0 $g/m^2$ starch for T-5, 2.6 $g/m^2$ starch for T-6.

| | NDC | Starch | Mixture NDC + Starch | NDC + STARCH (individually deposited) | | |
|---|---|---|---|---|---|---|
| | T-1 | T-2 | T-3 | T-4 | T-5 | T-6 |
| Theoretical deposit ($g/m^2$) | 1.5 | 5.1 | 5.5 | NDC: 2.1 Starch: 1.0 | NDC: 2.1 Starch: 2.0 | NDC: 2.1 Starch: 2.6 |
| Deposit evaluated after coating ($g/m^2$) | 1.3 | 3.5 | 4 | 2.7 | 3.3 | 3.2 |
| Mean transfer (%) | 87 | 69 | 73 | 87 | 73 | 68 |
| Permeability of citrated base substrate (CU) | 40 | 40 | 40 | 40 | 40 | 40 |
| Permeability of LIP areas (CU) (mean of 40 measurements) | 14.7 | 5.4 | 60 | 5.4 | 6.0 | 5.0 |
| LIP effect: Test ASTM E2187-04 (% cigarettes fully burnt) LIP if <25% | 100 | 50 | 21 | 50 | 22 | 17 |
| % cigarettes extinguished | 0 | 70 | 30 | 55 | 45 | 60 |

-continued

| | NDC | Starch | Mixture NDC + Starch | NDC + STARCH (individually deposited) | | |
|---|---|---|---|---|---|---|
| | T-1 | T-2 | T-3 | T-4 | T-5 | T-6 |
| in free air - FASE Diffusivity of LIP area-Sodim equipmt (cm/s) | 0.838 | 0.075 | 0.187 | 0.143 | 0.108 | 0.087 |

A better compromise is therefore obtained between the porosity of the paper 10, the LIP effect obtained and the diffusivity of the paper (toxicity of the article).

The method may further comprise a step during which all or part of the surface of the paper 10 is coated with combustion accelerator salts 14 to reduce the levels of nicotine, tar and carbon monoxide per cigarette.

According to one preferred embodiment, the coating 14 is applied to discrete areas, further preferably to all or part of the areas 12 non-treated with the coating formulation 13. Preferably, the salts are applied to all of the areas 12 of the paper which did not receive any LIP treatment.

The Applicant ascertained that the coating of LIP areas with accelerator salts, conforming to prior art techniques, entails numerous disadvantages.

Firstly, the objective of the accelerator salts 14 is to accelerate the burn rate of the cigarette, whilst the objective of the coating formulation 13 is to limit the supply of dioxygen in order to reduce combustion of the cigarette. The respective effects of the accelerator salts 14 and of the formulation 13 are therefore opposite effects, and total coating of the paper 10 with accelerator salts implies the use of a formulation further reducing the permeability of the paper to offset the effect of the salts.

Also, coating the entirety of the paper 10 creates areas having less extensive surface treatment, namely the bands 12 non-treated with the formulation, which generate surface stresses that are the cause of numerous problems when processing of the paper 10. By only applying the accelerator salts 14 to the areas 12 non-treated with the formulation, it is therefore possible to balance out the stresses on the surface of the paper 10. The paper 10 is hence easier to process which, in addition, reduces sheet waste.

Finally, the local coating of reducing salts 14 makes it possible to reduce the total quantity of salts applied to the paper 10, and hence to make substantial savings in terms of quantity of product used. Nonetheless, this step also entails additional difficulties for implementation compared with total coating of the paper, insofar as the salts 14 must be selectively applied to the paper 10. This is facilitated, however, by using printing machines to coat the paper 20 with the salts 14.

The accelerator salts 14 are conventional salts and may be chosen for example from among potassium citrate or sodium citrate.

In addition, the bands 12 of accelerator salts and the bands 11 that are LIP-treated are not necessarily applied to one same side of the paper 10. For example, it is possible to apply the LIP bands 11 onto one side of the paper 10, and the bands of accelerator salts 12 onto the other side of the paper 10, between the LIP bands 11. As a variant, the LIP bands 11 and the bands 12 of accelerator salts are both applied to both sides of the paper.

The surface coated with the LIP formulation 13 is preferably between 10% and 45%, more preferably between 15% and 35% and further preferably between 20% and 33% of the total surface equivalent to one side.

Also, the surface coated with accelerator salts 14 is between 90% and 55%, preferably between 85% and 60% and more preferably between 80% and 67% of the total surface equivalent to one side.

According to this embodiment of the invention, the increase in gram weight per square meter, grammage, therefore concerns the entirety of the surface and is not limited to localized bands corresponding to the LIP treated bands 11.

The variation in gram weight per square meter of the finished paper, which is generated by the combustion accelerator treatment, varies between 0.5 to 5% of the initial grammage of the cigarette base paper, preferably from 1% to 4% and more preferably from 1.5 to 3.5%.

The variation in gram weight per square meter of finished paper which is generated by LIP treatment varies from 1 to 10% of the initial grammage of the cigarette base paper, preferably from 3% to 6% so that the overall variation per square meter compared with the non-treated paper lies between 1.5 and 15%.

A description will now be given of some examples of smoking article papers 10 conforming to the invention, with the results of the tests performed on these papers, notably diffusivity tests, FASE, ASTM E2177-04 tests, or measurements of the permeability of the LIP areas, etc.

These examples were performed on the production line by means of a printing process using flexography.

Throughout these tests, the "wire side", which conventionally corresponds to the side of the paper in contact with the forming and drainage wire of the so-called Foudrinier flat table paper machine, was treated with the coating formulation. This side of the paper is more macroporous than the "felt side" corresponding to the opposite side, since it lies in the vicinity of drainage elements on the machine. However, treatment of the felt side can also be envisaged.

It is important to note that it is possible to place the side treated with the LIP-coating formulation 13 in contact with the tobacco roll 20, or it can be arranged on the outside of the smoking article, without this having any significant statistical effect on the results of ASTM and FASE tests. In the following examples, the side treated with the coating formulation was contacted with the roll of tobacco.

Industrially, this type of test plan is accessible on heliographic or flexographic printing machines. For example, a flexographic printing machine having one to eight printing stations is suitable for implementing the invention.

Two types of base papers were tested:

The first type of paper 10 had an initial grammage of 25.5 g/m$^2$ and a permeability of 70 Coresta. It also contained 27% calcium carbonate and was uniformly treated with 1.3% tripotassium citrate as combustion accelerator salt (the level of treatment being expressed as a percentage of anhydrous citric acid relative to the weight of the paper).

The second type of paper 10 also had a grammage of 25.5 g/m$^2$, a permeability of 70 Coresta, and 27% calcium carbonate but was not uniformly citrated.

The two types of paper 10 were treated with the LIP coating formulation 13 conforming to one embodiment of the invention, by laying bands 11 of seven millimeters spaced every twenty millimeters using four successive coating stations.

The second type of paper, in the areas 12 not LIP-treated, was coated with tripotassium citrate 14 as combustion accelerator salt using the other available stations of the printing machine. The solid content concentrations of citric salt tested in T-10 and T-11 were respectively 7% and 3%. With these concentrations, it was possible to arrive close to the targeted, final level of 1.3% tripotassium citrate expressed as anhydrous citric acid in the finished paper (obtained by treating non-LIP areas only).

| CONFIGURATION OF TESTS (g/m$^2$) | First type of paper | | | Second type of paper | |
|---|---|---|---|---|---|
| | T-7 NDC: 1.1 Starch: 2.6 | T-8 NDC: 2.1 Starch: 2.0 | T-9 NDC: 3.0 Starch: 2.0 | T-10 NDC: 2.1 Starch: 2.0 | T-11 NDC: 2.1 Starch: 2.0 |
| Theoretical LIP deposit on bands (g/m$^2$) | 3.7 | 4.1 | 5.0 | 3.7 | 4.1 |
| LIP deposit evaluated after coating on bands (g/m$^2$) | 2.8 | 3.1 | 3.6 | 2.8 | 3.3 |
| Theoretical deposit of tripotassium citrate/ grammage of substrate (g/m$^2$) | | | | 0.54 | 0.56 |
| Final paper grammage (g/m$^2$) | 26.3 | 26.4 | 26.5 | 26.3 | 26.9 |
| Anhydrous citric acid/ finished paper (%) | 1.3 | 1.3 | 1.3 | 1.25 | 1.31 |
| Permeability of the citrated base substrate, in CU | 70 | 70 | 70 | 70 | 70 |
| Permeability of LIP areas (mean of 40 measurements) (CU) | 19 | 11 | 9 | 17 | 10 |
| LIP effect ASTM E2187-04 test (% burnt cigarettes) LIP if <25% | 90 | 57 | 22 | 62 | 10 |
| % Free Air Self-Extinguished cigarettes FASE | 0 | 0 | 40 | 0 | 30 |
| Diffusivity of LIP area – Sodim apparatus (cm/s) | 0.216 | 0.198 | 0.120 | 0.215 | 0.177 |

The experimental plan was conducted with a progressive increase in nano-dispersed cellulose 13 on the first flexography stations, to obtain natural and significant restructuring of the substrate whose Sodium permeability was 70 Coresta.

For Tests No. 7 to 11, two different formulations 13*a*, 13*b* were successively applied to the paper areas to be LIP treated. The first 13*a* formulation contained nano-dispersed cellulose, whilst the second formulation 13*b* contained starch.

The volumes of the transfer rolls were chosen so that it was theoretically possible to transfer:

for Tests No. 7 and 10:1.1 g/m$^2$ (dry) of nano-dispersed cellulose 13*a* (V=11 cm$^3$/m$^2$) and 2.6 g/m$^2$ of starch 13*b* (V=26 cm$^3$/m$^2$);

for Tests No. 8 and 11: 2.1 g/m$^2$ (dry) of nano-dispersed cellulose 13*a* (V=21 cm$^3$/m$^2$) and 2.0 g/m$^2$ of starch 13*b* (V=20 cm$^3$/m$^2$); and for Test No. 9: 3.0 g/m$^2$ (dry) of nano-dispersed cellulose 13*a* (V=30 cm$^3$/m$^2$) and 2.0 g/m$^2$ of starch 13*b* (V=20 cm$^3$/m$^2$).

Tests No. 7 and 8 concerned the first type of paper 10, and Tests No. 10 and 11 concerned the second type of paper 10 which additionally comprised tripotassium citrate 14 discretely applied to the paper 10 to the proportion of a theoretical deposit of 0.98 g/m$^2$ (V=14 cm$^3$/m$^2$ obtained with 2×7 cm$^3$/m$^2$ and 3% dry extract) for Test No. 10, and 1.08 g/m$^2$ (V=36 cm$^3$/m$^2$ with 3×V=12 cm$^3$/m$^2$ and 7% dry extract) for Test No. 11.

In Test No. 10, about 70% of the solution 14 of reducing salts migrated onto the paper, hence a theoretical transfer of 0.69 g/m$^2$ of salt per localized area which, for a treated surface 12 of 70% compared with the initial surface, corresponds to a global increase in gram weight of the finished paper 10 per square meter of 0.48 g/m$^2$ due to the salts.

By applying the same reasoning for the LIP bands 11, but this time for the 30% remaining surface, we obtained a theoretical increase in gram weight of 0.78 g/m$^2$.

The actual increase for deposit on the LIP bands was 2.8 g/m$^2$, i.e. a global grammage increase of 0.84 g/m$^2$. The final grammage was 26.8 g/m$^2$, i.e. a salt treatment expressed in theoretical anhydrous citric acid of 1.1%.

For Test No. 11, the concentration of accelerator salts was reduced in the solution 14 and the volume of the solution 14 coated on the paper 10 was increased for further "re-wetting" of the paper 10 to cause relaxation thereof. The coating of the LIP-treated areas 11 is conducted using successive passes with drying between each pass which, as we have seen, sets up stresses on the surface of the paper 10 which tend to buckle the paper. By subjecting the entirety of the paper 12 to similar treatment in terms of wetting, involving successive wetting and drying of the areas 12 which did not receive a LIP treatment but were treated with accelerator salts 14, it is possible to achieve better balancing of the differences in stresses between the LIP-treated areas 11 and the saline areas 12. Three successive saline treatments were performed here.

By applying the same reasoning as above, the theoretical increase in grammage of the finished paper that is salt-related is 0.53 g/m$^2$, and the increase due to LIP treatment is 0.86 g/m$^2$, i.e. a final grammage of 26.9 g/m$^2$.

The theoretical percentage expressed as anhydrous citric acid is close to 1.2% compared with the finished paper.

The changes which occurred between Tests T-7 and T-9 again show the better efficacy of nano-dispersed cellulose regarding the capacity to obtain a local reduction in the porosity of the cigarette paper 10.

The ASTM tests, conducted on cigarettes manufactured industrially from papers of the first type, fully citrated, show that the ignition propensity of the paper diminishes since the number of burnt cigarettes was reduced between T-7 and T-9. Similarly, the FASE percentage, which is related to smoking pleasure, shows fully acceptable behaviour since it increased from 0 to 40% for the highest LIP paper.

The T-9 combination is a very good compromise between the LIP test as per the ASTM standard and the FASE test for fully citrated papers.

Finally, the diffusivity values decreased together with the ignition propensity of the tested papers, but the toxicity of the cigarettes obtained remained lower than that of conventional LIP cigarettes.

A comparison between the tests conducted firstly on fully citrated papers (first type of paper) and the tests conducted on papers discretely coated with the combustion accelerating saline solution (second type of paper) show that this type of coating 14 has very little impact on the permeability of the LIP bands 11 (see in particular T-7 and T-10, and T-8 and T-11). Therefore, the addition of accelerator salts to discrete areas 12 of the paper 10 allows better results to be achieved in terms of toxicity (greater diffusivity) whilst maintaining the properties of low ignition propensity (LIP) of the paper 10.

Nonetheless the LIP effect, as per the ASTM standard, is higher for papers discretely coated with the saline solution 14.

Therefore, permeability being equivalent, the application of accelerator salts 14 solely between LIP-treated bands 11 allows a significant increase in the LIP effect of the paper 10 according to the ASTM standard. Also, this is very promising pathway in terms of impact on the aspects of carbon monoxide, nicotine and tar levels, since diffusivity and permeability show that this new treatment pathway scarcely affects the toxicity of the paper 10 whereas the gain in self-extinguishing potential is significant.

The invention claimed is:

1. Paper for smoking article comprising areas treated with a coating formulation adapted to reduce the ignition propensity of said treated area, wherein said coating formulation comprises nanoparticles of cellulose, wherein said nanoparticles of cellulose form clusters having a median dimension (d50) equal or less than five micrometers.

2. The paper according to claim 1, wherein the nanoparticles comprise nanofibres, nanotubes, nano-filaments and/or nanorods.

3. The paper according to claim 1, wherein the size of the nanoparticles is equal to or less than 100 nm when taken individually.

4. The paper according to claim 3, wherein the nanoparticles are nano-dispersed cellulose (NDC).

5. The paper according to claim 4, wherein the areas are also treated with a formulation comprising a film-forming compound.

6. The paper according to claim 1, wherein the coating formulation further comprises a film-forming compound.

7. The paper according to claim 5 or 6, wherein the film-forming compound is selected from the group of starch, carboxymethylcellulose and methylcellulose.

8. The paper according to claim 1, wherein the treated areas are separated from each other by areas non-treated with the coating formulation, and in that said areas non-treated with the coating formulation are treated with combustion accelerating salts.

9. The paper according to claim 8, wherein the combustion accelerating salts are solely applied to the non-treated areas.

10. The paper according to claim 1, wherein the treated at are hands extending transversally having a width of between four and eight millimeters, and spaced apart two by two by a distance of between fifteen and twenty millimeters.

11. The paper according to claim 1, wherein the formulation also contains pigments.

12. The paper according to claim 11, wherein the pigments comprise aluminium hydroxide.

13. Paper for smoking article, comprising areas treated with a coating formulation adapted to reduce the ignition propensity of said treated area, wherein the formulation comprises nanoparticles of cellulose, wherein the size of the nanoparticles is equal to or less than 100 nm when taken individually.

14. The paper according to claim 13, wherein the nanoparticles comprise nanofibres, nanotubes, nano-filaments and/or nanorods.

15. The paper according to claim 13, wherein the nanoparticles are nano-dispersed cellulose (NDC).

16. The paper according to claim 13, wherein the areas are also treated with a formulation comprising a film-forming compound.

17. The paper according to claim 13, wherein the formulation further comprises a film-forming, compound such as starch, carboxymethylcellulose and/or methylcellulose.

18. The paper according to claim 13, wherein the treated areas are separated from each other by areas non-treated with the coating formulation, and in that said areas non-treated with the coating formulation are treated with combustion accelerating salts.

* * * * *

UNITED STATES PATENT AND TRADEMARK OFFICE

CERTIFICATE OF CORRECTION

PATENT NO. : 8,580,081 B2
APPLICATION NO. : 13/111884
DATED : November 12, 2013
INVENTOR(S) : Dumas et al.

It is certified that error appears in the above-identified patent and that said Letters Patent is hereby corrected as shown below:

In the Claims
Column 14, Claim 10, line 25, please delete "at" and insert --areas--, and line 26, please delete "hands" and insert --bands--.

Signed and Sealed this
Fifteenth Day of July, 2014

Michelle K. Lee

Michelle K. Lee
*Deputy Director of the United States Patent and Trademark Office*